United States Patent [19]

Schneider

[11] 4,233,824

[45] Nov. 18, 1980

[54] WARP KNITTING OF DOUBLE JACQUARD-PATTERNED PILE FABRIC

[75] Inventor: Manfred Schneider, Karl-Marx-Stadt, German Democratic Rep.

[73] Assignee: Veb Textima Wirkmaschinenbau Karl Marx Stadt, Karl Marx stadt, German Democratic Rep.

[21] Appl. No.: 51,415

[22] Filed: Jun. 25, 1979

Related U.S. Application Data

[63] Continuation-in-part of Ser. No. 45,852, Jun. 5, 1979, abandoned.

[30] Foreign Application Priority Data

Jun. 8, 1978 [DD] German Democratic Rep. ... 205859

[51] Int. Cl.[3] ..... D04B 23/02

[52] U.S. Cl. ..... 66/87

[58] Field of Search ..... 66/88, 87, 64, 62

[56] References Cited

U.S. PATENT DOCUMENTS

| | | | |
|---|---|---|---|
| 1,989,318 | 1/1935 | Hausser | 66/87 |
| 2,505,372 | 4/1950 | Strake | 66/87 |
| 3,455,123 | 7/1969 | Kohler | 66/87 |
| 3,646,782 | 3/1972 | Kohl | 66/87 |
| 3,733,856 | 5/1973 | Shima | 66/87 |

*Primary Examiner*—Ronald Feldbaum

*Attorney, Agent, or Firm*—Michael J. Striker

[57] ABSTRACT

A double, jacquard-patterned piled fabric is produced on a modified warp-knitting machine having two needle-rows whose needles form needle-pairs. Each needle-pair receives a respective set of pile threads, differing ones of which are at different points in a pattern to become patterning pile threads visible in the fabric's pile pattern. When a given pile thread is to be non-patterning, it is tied into one of the two ground fabrics in the form of a walewise-running unlooped thread, and is not knitted into the ground fabric in the form of either half or full loops, in order to greatly reduce the rate of consumption of non-patterning pile thread. When a pile thread is to become a patterning pile thread, it is displaced into the zone intermediate the two needle rows and incorporated into alternate ones of the two ground fabrics in the form of half-loops. When it is again to become a non-patterning pile thread, it is returned to one of the ground fabrics and again tied thereinto in the form of a walewise-running unlooped thread.

17 Claims, 13 Drawing Figures

WARP KNITTING OF DOUBLE JACQUARD-PATTERNED PILE FABRIC

CROSS-REFERENCE TO RELATED APPLICATIONS

This application is a continuation-in-part of my copending application Ser. No. 045,852, filed June 5, 1979 and entitled "Method and Device for the Production of Jacquard-Patterned Pile-Knit Fabrics."

BACKGROUND OF THE INVENTION

The present invention concerns the production of jacquard-patterned pile knits—such as carpets, upholstery, fur imitations, and the like—on warp-knitting machines of the type comprising two needle-rows. In this type of warp-knitting machine and technique, each of the two needle-rows is fed a large number of knitting threads for production of the two ground fabrics of a double pile fabric, and those pile threads which are to pattern are engaged by the hooks of the two needle-rows in alternation and are tied into respective ones of the two ground fabrics of the double pile warp knit in the form of half loops, whereas those pile threads which are, at any given time, not to appear in the visible pile pattern are kept out of the operative range of the needle hooks in order that they not be thusly tied into the ground fabric.

This is the type of warp-knitting machine and technique to which the present invention relates. Machines and methods of somewhat comparable type are also known, and warrant mention here.

Thus, Federal Republic of Germany Pat. No. DE 55821 discloses a pile-knitting machine having two needle bars, whose rows are arranged almost parallel to each other, with first one needle-row being driven out to yarn-taking position, and then the other, i.e., in alternation. Associated with each of the two needle-rows is a respective one of two rows of eyelet needles which feed to the needles of the associated needle-row the knitting threads to be used for formation of the ground fabric. Arranged above each two corresponding and oppositely located needles of the two needle-rows is one respective pile-thread guider of a row of such pile-thread guiders which extends along the length of the two needle-rows. The pile-thread guiders can be raised and lowered individually and are controlled by a jacquard system. The row of pile-thread guiders swings, as a unit, through the two needle-rows. If a particular pile thread is, at a particular time, not to appear in the visible pile pattern, it is lifted up by its associated pile-thread guider in such a way that, when this thread is in the general operative vicinity of one needle-row it not be caught by a hook of that needle-row. The pile thread which is not to appear in the visible pattern (hereafter called a "non-patterning" pile thread) is tied into one of the two ground associated with the other needle-row in accordance with fringe technique.

The disadvantage of this type of prior-art pile-knitting machine is that it is, accordingly, not possible to freely knit jacquard color patterns. Even if, instead of the single row of pile-thread guiders, use were made of a plurality of such pile-thread guider rows, with all the pile-thread guiders of such plural pile-thread guider rows individually controllable, jacquard color patterns could be achieved with only an unacceptable degree of quality. This is because it is not possible to move sets of bulked pile threads through the interneedle gaps of the needle-rows at high speed, if resort is to be had only to ordinary guidance techniques. Also, the tying-in of non-patterning pile threads in the form of full loops is extremely disadvantageous with respect to the rate of consumption of pile thread. Furthermore, the ground fabric of the piled knit, which is produced in accordance with elementary tricot technique, tends to be elastic and insufficiently shape-retentive, making it unsuitable, for example, for carpets.

For these reasons, until now jacquard-patterned pile knits have in general been produced only on warp-knitting machines having one needle bar and utilizing pile sinkers, pegs or grippers for the pile loops, such as disclosed, for example, in German Republic Pat. Nos. DD 110 073, DD 119 275, and DD 20 006.

However, with these warp-knitting machines, all those pile threads which are not to pattern are tied into their associated wale in the form of vertical stuffer. The rate of pile-thread consumption is accordingly high, i.e., higher than would be needed if one used a double-fabric carpet-weaving machine of the type capable of producing substantially the same patterned pile fabric.

SUMMARY OF THE INVENTION

It is one, general object of the invention to reduce the pile-thread consumption rate associated with such prior-art techniques, but without sacrifice of the high productivity of the type of knitting machine involved.

It is another object of the invention to provide a machine and method with which the non-patterning pile threads are so arranged in the fabric produced that each group of pile threads be associated with at least two wales.

It is a further object to provide a machine and method such that only the actually patterning pile threads need be moved through the interneedle gaps of the needle-rows.

It is a further object to be able to accomplish the above objects, and those more fully elucidated below, without any need to impose limitations upon the patterns which can be produced.

It is another object to be able to produce ground fabrics of high shape stability without sacrificing the high productivity of double-bar warp-knitting machines.

In the presently preferred embodiments of the inventive method and machine, use is made of a warp-knitting machine having two needle-rows the needles of each are arranged in a respective general plane. The needles of one of the two needle-rows are driven out, preferably in unison, into extended position and then retracted, and then the needles of the other needle-row are driven out into extended position, i.e., this proceeding in alternation. The general planes of the two needle-rows are so oriented that, if each plane were extended in the direction towards and to the yarn-taking location of the needles of the needle row, the two general planes would intersect above and between the two needle-rows.

Functionally, the needles of the two needle-rows are subdivided into a first needle-group and a second needle-group, with each first-group needle being located more or less directly opposite the respective second-group needle. For example, all the needles of the first needle-row could constitute, functionally speaking, the first needle-group, with all the needles of the second needle-row constituting the second needle-group. As another possibility, all the needles in the first half of the first needle-row and all the needles in the second half of the second needle-row could constitute the first needle-group; in that case, all the needles in the first half of the second needle-group (which needles are located directly opposite respective individual needles of the first half of the first needle-row) would constitute one part of the second needle-group, with the remainder of the second needle-group being constituted by all the needles in the second half of the first needle-row (which needles are located directly opposite respective individual needles of the second half of the second needle-row). As another possibility, the first, third, fifth, etc., needles of the first needle-row, plus the second, fourth, sixth, etc., needles of the second needle-row, would together constitute the first needle-group; and then, the second needle-group would be constituted by the second, fourth, sixth, etc., needles of the first needle-row, plus the first, third, fifth, etc., needles of the second needle-row. The possibilities just mentioned are mentioned only for the sake of explanation; there is no particular limit as to these possibilities, and the organization of first-group and second-group needles may depend on the pattern desired.

At each individual pair of oppositely located corresponding needles of the two needle-rows, one respective set of pile threads is fed at the side of the two-bar arrangement at which the first-group needle of the needle-pair is located. Thus, if it happens that the first needle-group is simply constituted by all the needles of the second needle-row, then, at each needle-pair along the length of the two-bar arrangement, a respective set of pile threads is fed alongside the second-row needle of each such needle-pair. More generally, however, the first needle-group will be constituted by needles of both needle-rows, so that, at some needle-pairs, the respective sets of pile threads are fed alongside the first-row needles (these being, at such needle-pairs, the first-group needles) whereas, at the other needle-pairs of the machine, the respective sets of pile threads are fed alongside the second-row needles (these being, at such needle-pairs, the first-group needles).

At each needle-pair along the length of the two-bar arrangement, those pile threads of the pile-thread set associated with this needle-pair which are not to appear in the visible pile pattern (as opposed to the one or more pile threads of this pile-thread set which are to appear in the pattern) are tried into that one of the two ground fabrics produced which is located at the first-group needle of this needle-pair. Such non-patterning pile threads are tied into the ground fabric walewise-running unlooped threads.

If now, one of the non-patterning pile threads in the set of pile threads associated with a particular needle-pair is to become a patterning pile thread, i.e., is now to appear in the visible pile pattern, this pile thread is deflected away from the first-group needle of the needle-pair in the direction towards the second-group needle of that needle-pair, passing above the first-group needle of the needle-pair. This now patterning pile thread is then laid over the second-group needle of the needle pair and is thereafter cast off the second-group needle along with the ground-fabric knitting loop on the second-group needle.

At this point, the now patterning pile thread is tensioned between its pile-thread guider, on the one hand, and, on the other hand, the cast-off location of the second-group needle of the needle-pair. Next, this pile thread is laid over the first-group needle of the needle-pair, and then cast off from the first-group needle along with the ground-fabric knitting thread which has meanwhile been laid over the first-group needle of the needle-pair.

One can then achieve a double patterned pile fabric, the two halves of which are of the same character and pattern, if the function of the first-group needles is performed by both first-row needles and second-row needles, in alternation in space and/or time.

As an example of this alternation considered with respect to space alone, assume that the first twenty needles of the first second needle-row always constitute first-group needles, with the oppositely located twenty needles of the second needle-row (forming therewith the first twenty needle-pairs) being always second-group needles; the next twenty needles of the first needle-row always constitute second-group needles, and the twenty associated needles of the second-needle-row constitute first-group needles; etc., proceeding along the length of the two-bar arrangement. So long as a particular pile pattern is being formed, those needles which perform the function of the first needle-group never perform the function of the second needle-group and, likewise, those needles which perform the function of the second needle-group never perform the function of the first needle group.

As an example of the aforementioned alternation considered with respect to time alone, assume that the needles of the first needle-group are, simply, constituted by all the needles of the second needle-row, and that accordingly the needles of the second needle-group are constituted by all the needles of the first needle-row, i.e., during the formation of the first half of the pattern to be implemented. When, now, the second half of the pattern is to be implemented, all the needles of the first needle-row instead assume the function of the first-group needles, i.e., become the first-group needles, and accordingly all the needles of the second needle-row take over the function of the second-group needles. This is an extreme example, and is set fourth for explanatory purposes.

More generally, the alternation performance of the first-group and second-group functions by first-row and second-row needles involves an alternation in space and in time. Thus, in the extreme example just given, it would be more feasible that all the needles of the first needle-row not simultaneously take over the role of first-group needles, but that instead, proceeding along the length of the two-bar arrangement, successive first-row needles take over and then for a while retain the role of the first-group needles, one-by-one, during the formation of successive individual courses, for example.

As a further possibility, the set of pile threads fed to each needle-pair, or to particular needle-pairs, may for example consist of four pile threads, with the first-row needle of the needle-pair acting as the first-group needle with respect to two of these four pile threads but acting as the second-group needle with respect to the other two of the four pile threads.

High longitudinal-direction stability of the ground fabric can be achieved if the non-patterning pile threads are tied in between the stuffer threads and the sinker loops of the actual ground-fabric knitting threads, with the latter being laid on the first-row and second-row needles in accordance with tricot technique.

If the actual ground-fabric knitting threads are laid on the first-row and second-row needles in accordance with fringe technique, then it is also possible to utilize the ground-fabric knitting threads to tie in the non-patterning pile threads in alternate wales, with the non-patterning pile threads forming a walewise-running stuffer confined to a respective wale but extending back and forth in alternate directions.

Generally, if the number of pile threads associated with one needle of a needle-pair is lower than three, the needle should furthermore be fed with a walewise-running unlooped thread (not capable of becoming a pile thread, because not coming from a pile-thread guider), along with the presently non-patterning pile threads.

In the warp-knitting machine employed for this technique, each needle-pair is provided, above it, with a respective set of individually shiftable pile-thread guiders, each pile-thread guider feeding one individually selectable pile thread. The pile-thread guiders of each such set are individually shiftable within the angular sector implied by the intersection of the general planes of the two needle-rows. When a particular one of the pile threads in this set of pile threads is to be selected for appearance in the pile pattern, its pile-thread guider is shifted in the direction from the first-group needle of the needle-pair towards the bisector of the angular sector just mentioned.

This angular sector is furthermore occupied by a guide comb, which extends between the two needle rows along the length of the two-bar arrangement. The guide comb has a succession of sinkers, one per needle-pair. Each guide-comb sinker has two laying edges. One laying edge extends parallel to the first-row needle of the associated needle-pair, and is located close to the position assumed by the hook of the first-row needle, when the latter is driven out into extended position. The other laying edge of each guide-comb sinker, correspondingly, extends parallel to the second-row needle of the needle-pair and is located close to the hook thereof. The entire guide comb is laterally shiftable, i.e., along the length of the two bar arrangement or, equivalently started, perpendicular to the plane implied by the two needles of a needle-pair. The guide comb is laterally shifted in this way to correctly lay the actually patterning pile threads over the throats of their respective needles, i.e., so that the actually patterning pile threads be caught in the hooks of these needles.

Each first-row needle has a knitting-thread guider, located at the side of the first needle-row, i.e., with the respective first-row needle located between its knitting-thread guider and the corresponding second-row needle. Each second-row needle has a knitting-thread guider located at its side of the two-bar arrangement, i.e., with the respective second-row needle located between its knitting-thread guider and the corresponding first-row needle.

First and second rows of loop-clearing sinkers are provided, each first-row needle being provided with a respective such sinker in the first row of such sinkers, and each second-row needle being provided with a respective such sinker in the second row of such sinkers. The non-patterning pile threads in the set of pile threads associated with each respective needle-pair are guided between two adjoining loop-clearing sinkers of one of the two rows of loop-clearing sinkers.

Advantageously, two rows of stuffer-thread guiders are provided, one row of such guiders associated with the first needle-row, the other with the second needle-row. Each stuffer-thread guider is advantageously located between the cast-off location of its associated needle-row and the row of loop-clearing sinkers associated with that needle-row.

As one advantageous possibility, the two rows of knitting-thread guiders and the guide comb are coupled together to perform an identical transverse shifting movement, i.e., a movement perpendicular to the plane implied by the two needles of any needle-pair. This can be accomplished by simply mounting the two rows of knitting-thread guiders and the guide comb on a common transversely shifted mounting structure.

The knitting-thread guiders advantageously comprise little tubes, and each pile-thread guider is advantageously constituted by an eyelet formed in a shiftably mounted thin rod or wire. The thin rods provided with the pile-thread guiders are shifted in the direction from one to the other needle-row, under the control of a jacquard system.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 3*a*–6*a* depict successive steps of the pile-forming method, the plane implied by the two needles of a needle-pair being perpendicular to the plane of these Figures;

FIGS. 3*b*–6*b* depict the same method steps as in FIGS. 3*a*–6*a*, respectively, but with the plane implied by the two needles of a needle-pair being parallel to the plane of these Figures;

DESCRIPTION OF THE PREFERRED EMBODIMENTS

Figure 1:
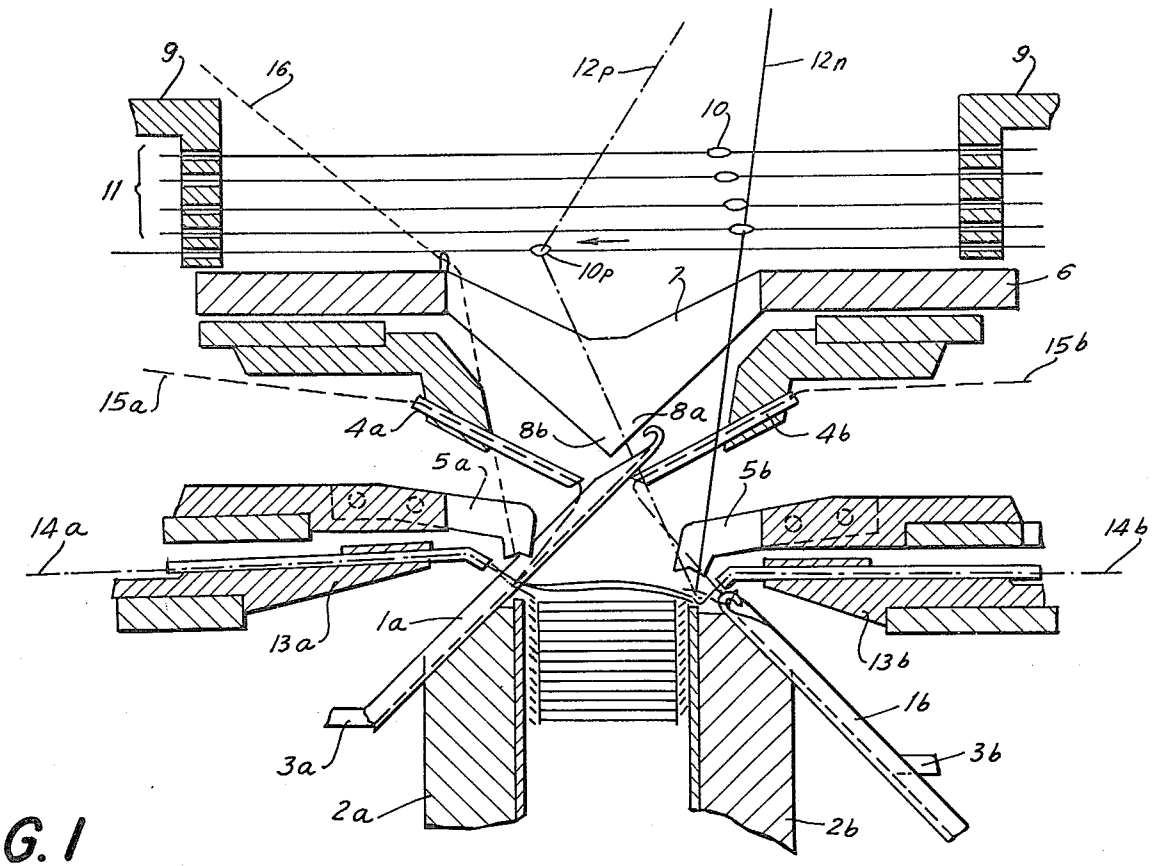
FIG. 1 is a cross-section taken through a warp-knitting machine in accordance with the present invention, t the loop-forming location of the machine.

FIG. 1 depicts in cross-section a warp-knitting machine at the loop-forming location thereof, and depicts the needles of the machine to the extent of one representative needle-pair. The needles 1*a* of the left needle-row are guided in a left stationary cast-off bar 2*a*, and the needles 1*b* of the right needle-row in the right cast-off bar 2*b*. The needles 1*a* and 1*b* each make an angle of about 45° with respect to the horizontal. It will be understood that the two cast-off bars 2*a*, 2*b* extend perpendicular to the plane of the illustration, with further such needles 1*a* and 1*b* located behind and in front of the two needles 1*a*, 1*b* here depicted. The general plane defined by the left needle-row 1*a* and the general plane defined by the right needle-row 1*b* intersect at approximately the height of the hook of a needle which has been driven out to extended position. Preferably, all left-row needles 1*a* are driven out to extended position and then lowered, and then all right-row needles 1*b* driven out and then lowered, i.e., proceeding in alternation. The general plane implied by the left needle-row 1*a* (which general plane is normal to the plane of illustration in FIG. 1) and the general plane implied by the right needle-row 1*b* (likewise normal to FIG. 1) form an angle of intersection alpha.

The illustrated left needle 1*a* (and each such left needle) is provided with a respective knitting-thread guider 4*a*, which feeds to it the thread used for the actual warp-knitting of the left ground fabric. Left knitting-thread guider 4*a* is located in front of its associated left needle 1*a*, i.e., with needle 1*a* located intermediate guider 4*a* and the other needle 1*b* of the illustrated needle pair when the needle 1*a* is in extended position. Likewise, the right knitting-thread guider 4*b* for the right needle 1*b* of the illustrated needle-pair is located in front of needle 1*b*. The left row of knitting-thread guiders 4*a* extends in the direction perpendicular to the plane of illustration of FIG. 1 and is shiftable in this direction, as a unit, i.e., is transversely shiftable, in order to properly lay knitting threads onto the left-row needles 1*a* in correspondence to the production technique employed for the left ground fabric, e.g., simple tricot. The same comments apply to the right row of knitting-thread guiders 4*b*.

The left and right needle-rows 1*a*, 1*b* are each provided with a respective row of loop-clearing sinkers 5*a*, 5*b*, each row of loop-clearing sinkers including one such sinker per needle of the associated needle-row. The loop-clearing sinkers 5*a*, 5*b* assure an orderly cast-off operation and prevent the two halves of the double fabric from hitching up when the needles of their respective needle-rows are driven out to raised position. The loop-clearing sinkers 5*a*, 5*b* are vertically shiftable, but also transversely shiftable (i.e., shiftable in the direction normal to the plane of illustration of FIG. 1) in correspondence to the trying-in scheme employed for the non-patterning ones of the pile threads, described below. Each row of loop-clearing sinkers is transversely shiftable as a whole.

Within the angular sector alpha above the hooks of needles 1*a*, 1*b* there is arranged a guide comb 6 having a row sinkers 7. The row of sinkers extends transversely (normal to the plane of illustration in FIG. 1). The sinkers 7 on guide comb 6 are spaced at intervals identical to the intervals at which needles of either needle-row are spaced within their needle-row. Each such sinker 7 has a left laying edge 8*a* and a right laying edge 8*b*. Each laying edge 8*a*, 8*b* is oriented substantially parallel to the direction of elongation of the needles 1*a* or 1*b* of its respective needle-row, and is furthermore located quite close to the hooks of such needles, when those needles are in extended position. The guide comb 6 is transversely shiftable (i.e., shiftable in the direction normal to the plane of FIG. 1) as a whole, for purposes described below. Here, the guide comb 6 is not vertically reciprocable; however, the guide comb 6 can appropriately be made vertically reciprocable when exceptional finenesses (very dense interneedle spacing) are involved, in which case this would serve to more reliably lay the patterning pile threads onto the throats of the needles.

Above the guide comb 6 is a support structure 9 for the machine's pile-thread guidance system. In the illustrated embodiment, there is arranged above each individual needle-pair 1*a*, 1*b* five pile-thread guiders 10, here provided in the form of eyelets on thin horizontally extending rods or wires 11 which are guided through apertures in the illustrated support structure 9. The thin rods 11 are individually shifted, in order to shift the individual pile-thread guiders 10, by means of a (non-illustrated) jacquard mechanism. Such jacquard mechanisms are of course familiar to persons skilled in the art. The five illustrated pile-thread guiders 10 pertaining to the illustrated needle-pair 1*a*, 1*b* are arranged one above the next, preferably with different respective spacings from the plane of illustration in FIG. 1.

In FIG. 1, the four pile-thread guiders 10 at the right guide pile threads 12*k*, 12*l*, 12*m*, 12*n* (only 12*n* shown explicitly, to avoid crowding) which at present are not to appear in the visible pile pattern of the fabric. These four pile-thread guiders 10 are located more or less directly above the cast-off location of the right needle-row 1*b*. The pile-thread guider 10*p* for the pile thread 12*p* which at present is to appear in the visible pile pattern is shifted, in the direction from the needle alongside which the non-patterning threads 12, 121, 12*m*, 12*n* extend towards the other needle, namely from needle 1*b* to needle 1*a* in FIG. 1, past the bisector of angle alpha.

Figure 2:
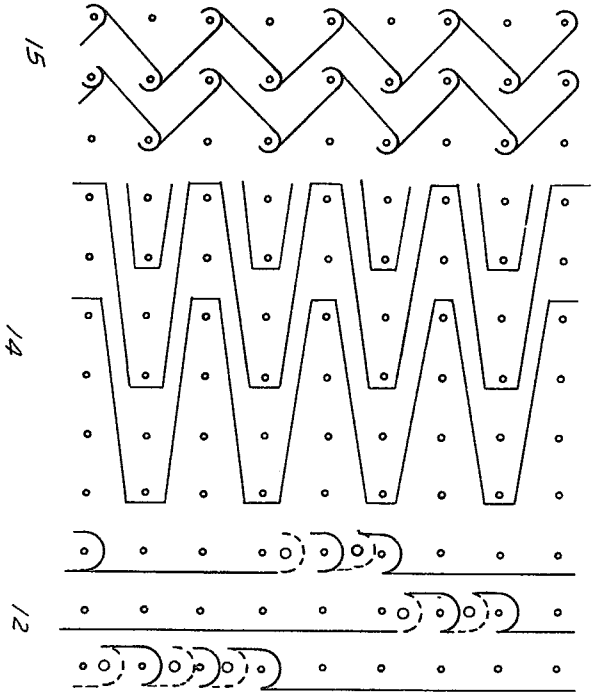
FIG. 2 is a thread-laying diagram for one of the two halves of the double paterned pile fabric formed.
Figure 3A:
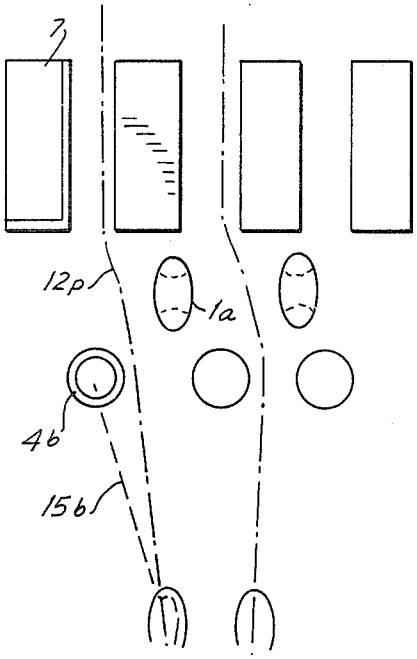
Figure 3B:
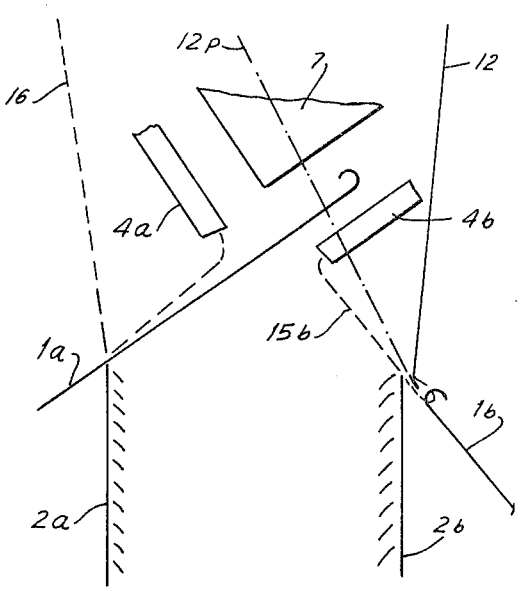

The operations performed at the representative needle-pair 1*a*, 1*b* shown in FIG. 1 are as follows:

As shown in FIG. 1, and also in FIG. 3*b*, the left needle 1*a* is initially located in its extended position. At this time, right needle 1*b* is in cast-off position. Its stuffer-thread guider 13*b* performs a transverse shift and lays stuffer thread 14*b* beneath four adjoining ones of such right needles 1*b*. Attention is directed to the thread-laying diagram of FIG. 2, and in particular to the part thereof at 14. Simultaneously, because pile thread 12*p* is now to become a patterning pile thread, its pile-thread guider 10*p* is shifted leftwards to patterning position, i.e., to the position at which guider 10*p* is shown in FIG. 1. Accordingly, as shown in FIG. 3*b*, pile thread 12*p* is located alongside the throat of left needle 1*a* but, as shown in FIG. 3*a*, has not yet actually been laid across the throat of the needle.

Figure 4A:
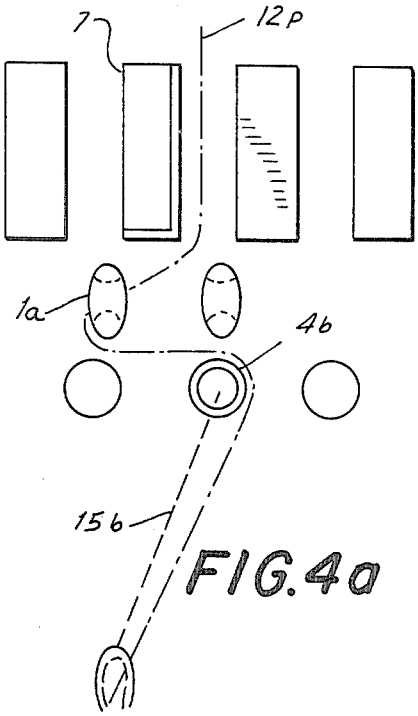
Figure 4B:
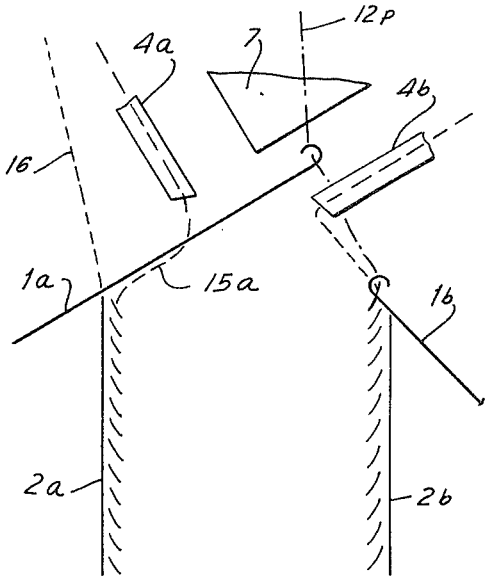

Next, the guide comb 6 is transversely shifted, by a distance equal to about 1.5 times the interneedle interval, and the right-row knitting-thread guiders 4*b* are transversely shifted in the same direction by the same amount. This transverse shift of both guide comb 6 and the right-row knitting-thread guiders 4*b* can be seen by comparing FIG. 4*a* against FIG. 3*a*. To facilitate comparison, in each of FIGS. 3*a*–6*a* one and the same sinker 7 on guide comb 6 is shown hatched, and in FIGS. 3*a* and 4*a* one and the same right-row knitting-thread guider 4*b* is shown as a double circle. In going from FIG. 3*a* to FIG. 4*a*, it will be seen that both the guide comb 6 with its sinkers 7 and the right-row knitting-thread guiders 4*b* are both transversely shifted in the same direction and by the same amount of about 1.5 times the interneedle interval. In particular, the sinker to the left of the hatched sinker 7, in going from the FIG. 3*a* position to the FIG. 4*a* position, lays the patterning pile thread 12*p* across the throat of the needle 1*a* of FIGS. 1 and 3*b*–6*b*. Also, as shown in FIG. 4*b*, the left-row knitting-thread guider 4*a* lays the left-side knitting thread 15*a* over the shank of needle 1*a*.

Now, when the left-row needles 1*a* are pulled down, both the pile thread 12*p*, which was laid across the throat of the left needle 1*a* of the needle-pair in question, and also the left-side knitting thread 15*a* which was laid across the shank of the same needle, enter into the hook of the needle 1*a* as the latter moves all the way down into cast-off position. Each needle 1*a*, 1*b* is provided with a respective sliding hook closer 3*a*, 3*b*. In FIG. 1, the hook of left needle 1*a* is shown open, but the hook of right needle 1*b*, which is in cast-off position, is shown closed by its hook closer 3*b*. Accordingly, as shown in FIGS. 5*a* and 5*b*, the patterning pile thread 12*p* and the left-side knitting thread 15*a* will form a loop.

Figure 5A:
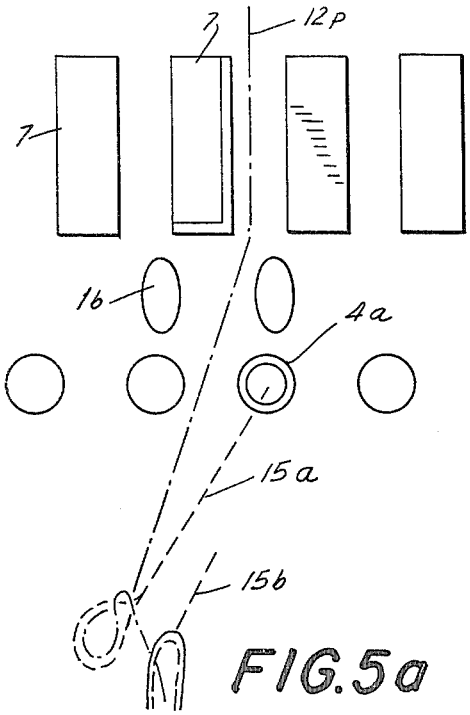
Figure 5B:
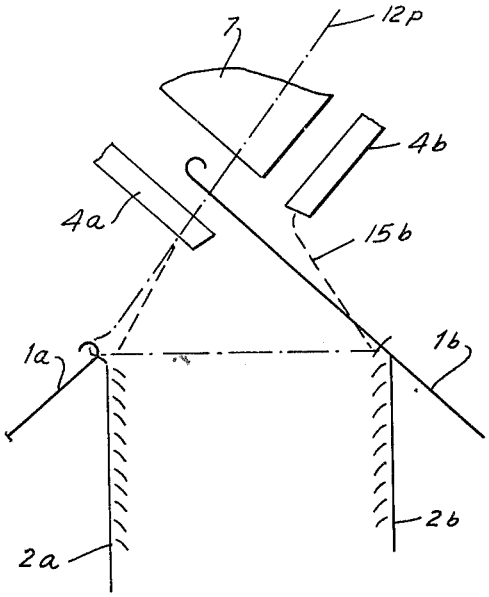

Meanwhile, as shown in FIG. 5*b*, the right-row needles 1*b* have been driven out to extended position, the right-row needles simply passing through the gaps between successive sets of non-patterning pile threads. During the ascent of the right-row needle 1*b*, the patterning pile thread 12*p* does not become hitched on or in any other way improperly wound around or laid on this needle because, at this time, the patterning pile thread 12*p* is being positively oriented by both a sinker 7 on guide comb 6 and by a left-row knitting-thread guider 4*a*; this is shown in FIG. 5*a*, where both the sinker 7 to the immediate left of the hatched sinker, and also the guider 4*a* to the immediate left of the double-circle guider, are shown pressing the patterning pile thread 12*p* rightwards, away from the left one of the two illustrated needles 1*b*. (The same thing of course happens when the left-row needle 1*a* is driven out to raised position. As shown in FIG. 3*b*, there, as left needle 1*a* rises both a sinker 7 and a right-row knitting-thread guider 4*b* prevent the patterning pile thread 12*p* from becoming in any way hitched on needle 1*a*.)

Figure 6A:
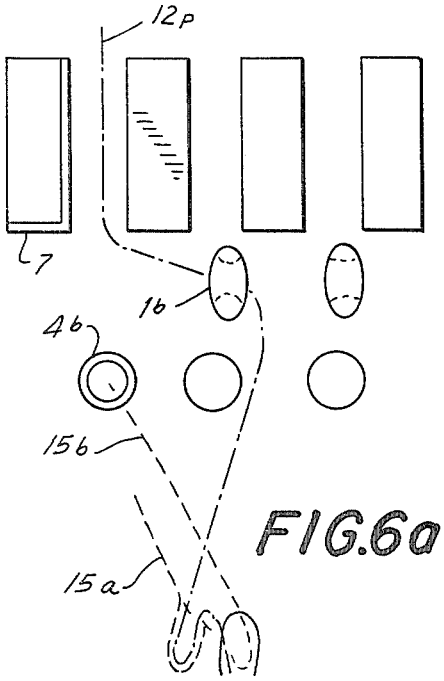
Figure 6B:
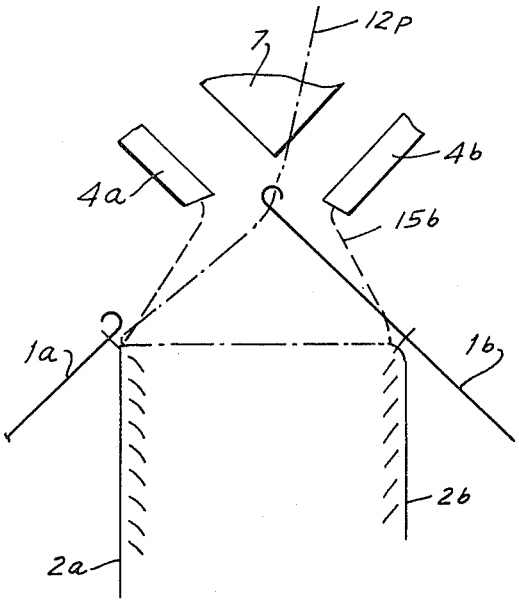

Next, one proceeds from the situation depicted in FIGS. 5*a*, 5*b* to that depicted in FIGS. 6*a*, 6*b*. The guide comb 6 with its sinkers 7 is now transversely shifted in the opposite direction, again by an amount equal to about 1.5 times the interneedle interval, in order to lay the patterning pile thread 12*p* across the throat of right-row needle 1*b*. Also, the right-row knitting-thread guiders 4*b* transversely shift in the same direction by the same amount, in order to lay the right-side knitting thread 15*b* across the shank of needle 1*b*. Accordingly, when right-row needle 1*b* now descends, both the patterning pile thread 12*p* and the right-side knitting thread 15*b* will be caught in the hook of this needle, the hook being closed by this needle's hook closer 3*b*, and the procedure will have returned to the point shown in FIG. 1 and in FIGS. 3*a* and 3*b*, whereupon the procedure starts anew.

If at this or a later such point in the procedure, pile thread 12*p* is to cease to appear in the pattern, and one of the non-patterning pile threads 12*k*, 12*l*, 12*m*, 12*n* is to become the patterning pile thread, the pile-thread guider 10*p* of the presently patterning pile thread 12*p* is shifted rightwards in FIG. 1 to join the guiders 10 of the other non-patterning pile threads, and the guider 10 of the newly selected pile thread is shifted leftwards to the position shown in FIG. 1 for guider 10*p*.

Figure 12:
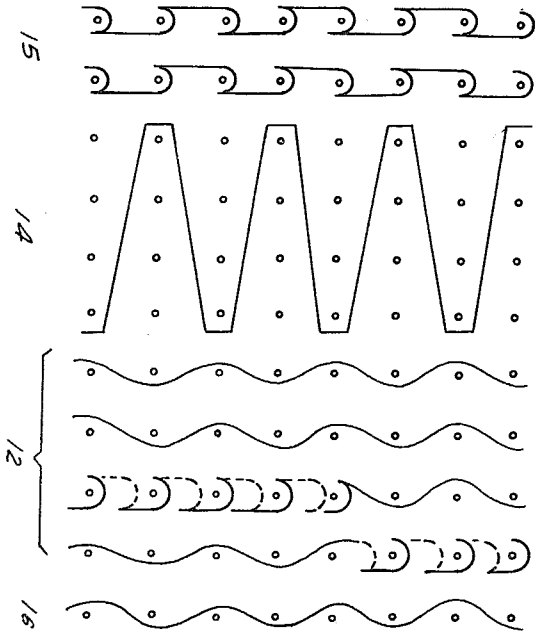
FIG. 12 is a further thread-laying diagram.

Of course, depending upon the fabric construction desired, the various operating elements can be provided with special threads and/or perform additional or special shifting motions. If the knitting-thread guiders 4*a*, 4*b* are transversely shifted to lay the knitting thread 15*a*, 15*b* across the needles in accordance with tricot technique, the non-patterning ones of the pile threads 12 are tied in between the stuffer threads 14 and the sinker loops of the actual knitting threads 15 in the form of simple walewise-running unlooped threads and the loop-clearing sinkers 5 need perform no transverse shifting motion (FIGS. 7–11). If the actual knitting threads 15 are laid across the needle shanks in accordance with fringe technique (FIG. 12), then the loop-clearing sinkers 5 must perform a shift underneath a needle, so that the non-patterning pile threads be laid under such needle to form a walewise-running unlooped thread which although confined to one wale alternates in direction.

In the foregoing description of FIGS. 1–6, it has been assumed that, in each needle-pair, the right-row needle is the one alongside which the non-patterning pile threads are fed, with the result that the non-patterning pile threads become incorporated only into the right half of the double fabric produced. This is possible in a practical sense, and furthermore makes possible the use of a simpler jacquard system and simpler work for the person who programs the jacquard system. However, in that event, in order that the two halves of the double fabric have, to a very high degree, identical character, it is necessary that there be incorporated into the left fabric half a special vertical thread 16 (see FIG. 1), which accordingly serves somewhat the function of the so-called stem thread in weaving. It serves to provide corresponding longitudinal-direction stability in the left fabric half. Such a stem or vertical thread 16 should also be considered, when there are associated with a needle of a needle-pair fewer than three pile threads. This can be the situation, as described below, if the set of pile threads associated with one needle-pair is, for example, subdivided into two subsets, one associated with one needle of the pair and the other with the other needle, and with the patterning pile thread accordingly coming from first one and then from the other of the two subsets; if each subset consists of fewer than three pile yarns, then a stem or vertical thread 16 should be incorporated into both wales, i.e., into both fabric halves at the two wales associated with such needle-pair.

Thus, although it has been assumed for explanatory purposes that the non-patterning pile threads are always kept at the right-row needles in FIG. 1, this is but one of many such possibilities. To generalize the other such possibilities, the needles of the two needle-rows should be considered as subdivided into a first needle-group and into a second needle-group. The needles of the first needle-group are the ones alongside which the non-patterning pile threads are fed. In each needle-pair, one needle of the pair belongs to the first needle-group and the other to the second needle-group. Thus, for the case assumed above, the first needle group would be constituted, very simply, by all the right-row needles 1*b*, and the second needle-group by all the left-row needles 1*a*.

However, so simple a subdivision of the needles of the two needle-rows into two needle-groups is but the most elementary possibility. In general, the functions performed by the first and second needle-groups can alternate, with respect to space and/or time, as between the needles of the first and second needle-rows.

For example, with regard to alternation in space alone, in the first, third, fifth, etc., needle-pairs of the two-bar arrangement, the first-row (e.g., left-row) needle of each of those needle-pairs can constitute needles of the first needle-group, with the second-row (e.g., right-row) needle of each of those needle-pairs accordingly performing the role of a needle of the second needle-group; and in the second, fourth, sixth, etc., needle-pairs of the machine, the first-row needle of each of those needle-pairs constituting a second-group needle, and the second-row needle in each of those needle-pairs accordingly constituting a first-group needle. This is shown in FIG. 9. In contrast, FIG. 8 depicts the more elementary possibility, i.e., all right-row (b) needles together constituting the first needle-group, and all left-row (a) needles together constituting the second needle-group.

Figure 8:
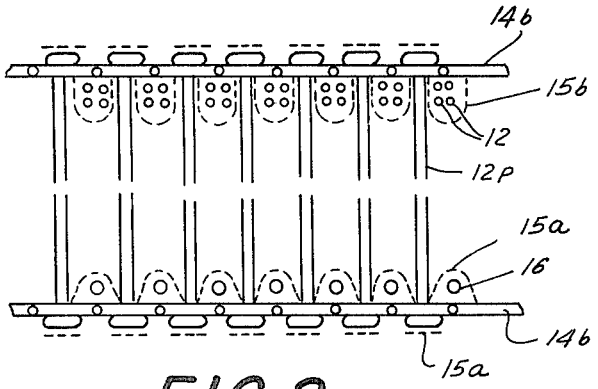
FIGS. 8–9 depicts three representative variants of the double patterned pile fabric produced.
Figure 9:
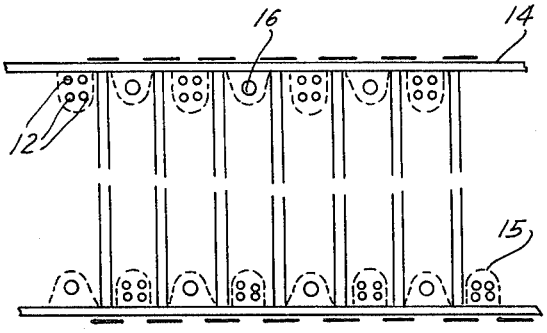
Figure 10:
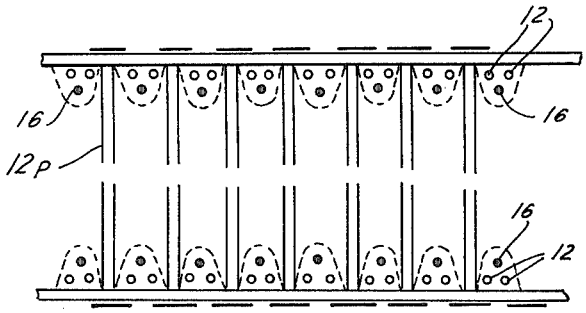

Alternation of first and second needle-group functions as between the first and second needle-rows, in time alone, would be constituted, for example, by reversal of the situation depicted in FIG. 8, midway through the implementation of the pile pattern. Thus, midway through knitting of the pile pattern, the non-patterning pile threads would be shifted over to the left-row needles, and also the stem or vertical thread 16 shifted (e.g., by means of an eyelet guidance technique such as used for the pile threads) to the right-row needles. More typically however, this reversal of first and second needle-group roles within the individual needle-pairs would not occur at all needle-pairs simultaneously, but instead, for example, consecutively, one needle-pair at a time, during the knitting of respective successive courses or, for example, with the role reversal occurring at the 10th, 20th, 30th, etc., needle-pairs during the knitting of one course, at the 11th, 21st, 31st, etc., needle-pairs during the knitting of the next course, and so forth; or in accordance with another such schedule.

In general, when the first needle-group is not simply and permanently constituted by all the needles of one needle-row and the second needle-group by all the needles of the other needle row, then, in any given needle-pair, when a different one of the pile threads is to become the patterning pile thread its guider 10 should be moved to selected or patterning position when the first-group needle of that needle-pair is in cast-off position. The same remark applies to the case where, in a needle-pair, the non-patterning pile threads are not relegated to one of the two needles of the pair but instead are divided as between both needles. Thus, in FIG. 10, it will be seen that each needle-pair is here, by way of example, provided with a total of four pile threads 12, two associated with one needle of the pair the other two with the other. The pile thread which is actually to pattern can accordingly come out from either the one or the other of the two pairs of pile threads. In that event, inasmuch as there is associated with each needle of the needle-pair fewer than three pile threads, a respective stem or vertical thread 16 is fed to each of the two needles of the needle-pair. During patterned knitting, this may result in small faults or fault locations in the fabric, but these will anyway not be visible if the density of the fabric's pile is ordinarily great.

The advantage of the double patterned pile knit fabric produced in any of these ways is that both fabric halves have substantially identical fabric character, and indeed will often have actually identical fabric structure, but with a minimal rate of consumption of pile thread.

Figure 7:
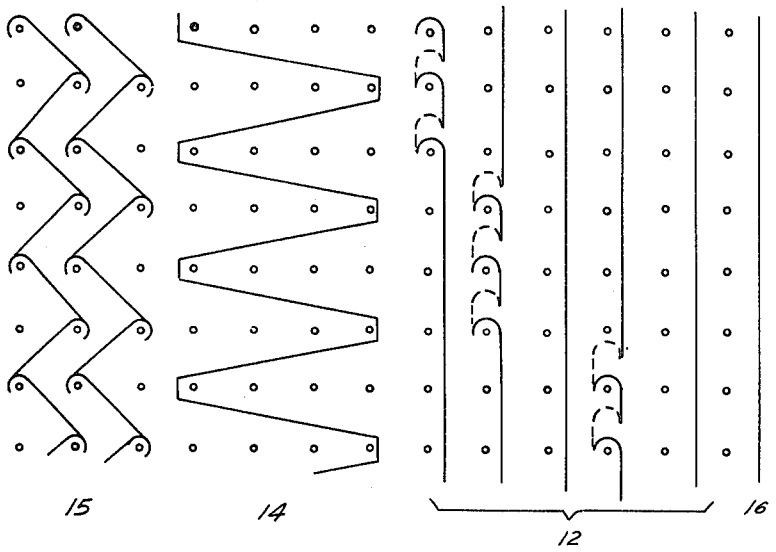
FIG. 7 is another thread-laying diagram.
Figure 11:
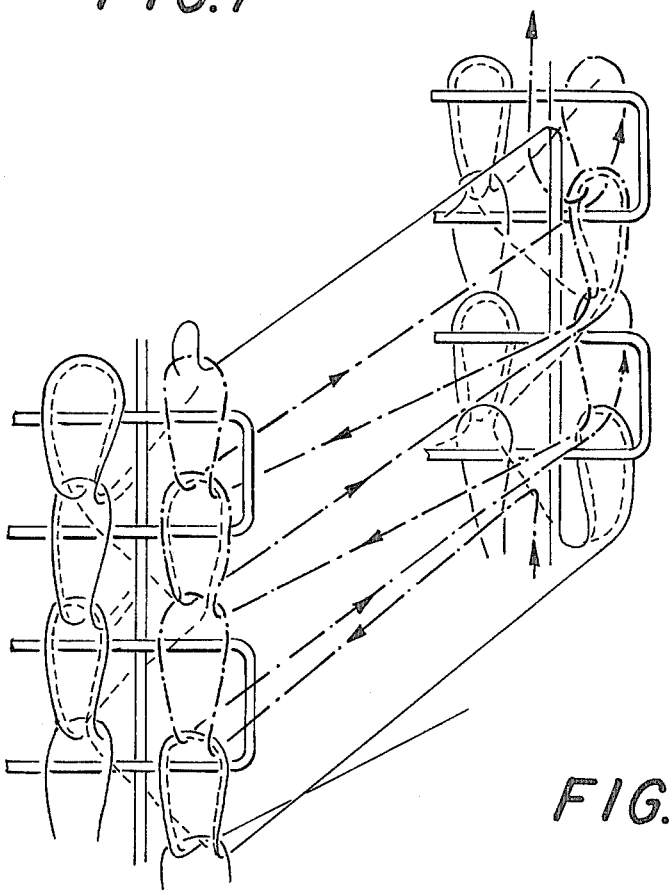
FIG. 11 is a perspective representative of the fabric structure corresponding to the thread-laying diagram of FIG. 7.

Although persons skilled in the art do not need it, FIG. 11 depicts by way of example the actual structure of a double, patterned, warp-knit pile fabric produced in accordance with the invention, corresponding to the thread-laying diagram of FIG. 7. Two wales of the front fabric half are shown at the lower left in FIG. 11, and the two corresponding wales of the rear fabric half are shown at the upper right in FIG. 11, with patterning pile threads extending back and forth between the front and rear fabric halves. In FIG. 11, in the two illustrated wales of the front fabric half, only a single warp-knit thread chain, constituted by a knitting thread 15, is shown, as a broken line. In the usual way, this knitting thread 15 alternates, here by way of example, two wales of the fabric. In the front fabric half, the stitch chain to the left of the illustrated one is not depicted, nor is the neighboring stitch chain to the right of the illustrated one depicted. In FIG. 7, at 15, the alternation of two adjoining knitting threads 15, back and forth, between two adjoining wales is shown. Although there is shown in FIG. 7 this conventional zig-zag for only two knitting threads 15 to avoid superposition and crowding, it will be understood that, in general, each needle of the needle-row involved will have its knitting thread 15 zig-zagging in the manner shown at 15 in FIG. 7. In FIG. 11, for the front fabric half, a part of the zig-zagging stuffer thread 14 is shown, as a double line. As shown at 14 in FIG. 7, the stuffer thread 14 is laid under (i.e., behind groups of four adjoining needles each, the laying-under occurring as explained above when these needles are in their cast-off positions.

In FIG. 11, a total of three pile threads 12 are available to each needle-pair. The non-patterning pile threads 12 are incorporated into the rear fabric half, as simple walewise-running unlooped threads, as shown. A patterning pile thread **12*p* is shown in dash-dot lines, zig-zagging between the front and rear fabric halves for a total of three courses. In the rear fabric half, in the lowermost one of the four courses there illustrated, the patterning pile thread 12*p* has not yet become a patterning pile thread (i.e., has not yet been selected for patterning), and is still incorporated into the rear fabric half as a walewise-running unlooped thread. The pile thread 12*p* is then selected out, in the manner already described, and forms a half-loop in the front fabric half, in particular in the second illustrated course and the right illustrated wale thereof. This is only a half-loop, in warp-knitting terms, because the two sinker loops of this pile-thread stitch are chained into the needle loop of only the stitch directly beneath it, i.e., into only a stitch of the same wale and not, in true warp-knitting manner, into the needle loops of two different wales. This front-fabric, right-wale, second-course loop formed by patterning pile thread 12*p* is shown in FIG. 11 not accompanied by a warp-knitting stitch of the knitting thread 15, but as explained earlier when this pile-thread loop is formed it is formed actually accompanied by a warp-knitting loop of knitting thread 15; as already stated, to avoid crowding in FIG. 11, the adjoining stitch chain formed by the knitting thread 15** to the right of the one illustrated is not explicitly shown.

Next, the selfsame patterning pile thread **12*p* goes back to the rear fabric half, and forms a half-loop in the second illustrated course and the right illustrated wale thereof. Again, it is to be understood that, if the neighboring knitting-thread stitch chain of the rear fabric were expressly depicted, this half-loop formed by pile thread 12*p* would be shown accompanied by a loop of knitting thread 15**.

Next, the self-same patterning pile thread **12*p* comes forward again towards the front fabric half and forms a half-loop in the third illustrated course and the right illustrated wale thereof. As always, this half-loop formed by patterning pile thread 12*p* is accompanied by a loop of the knitting thread 15. In this third course of the right wale of the front fabric illustrated, the accompaniment by a loop of knitting thread 15 is expressly shown, thread 15 shown as a broken line, because at this course and wale the thread with whose loop pile thread 12*p* forms a half-loop happens to be the knitting thread 15** actually depicted.

Next, the same pile thread 12*p* goes back to the rear fabric half and forms a half-loop in the third illustrated course and the right illustrated wale, here again the accompanying loop of knitting thread 15 being explicitly depicted.

Then, pile thread 12*p* again forms such a half-loop in the fourth course, right wale, of the front fabric half.

Then, pile thread 12*p* again forms such a half-loop in the fourth course, right wale, of the rear fabric half.

After forming the fourth-course right-wale half-loop in the rear fabric half, patterning pile thread 12*p* is, at this point, now to become a non-patterning pile thread. Accordingly, it is not brought forward again to the front fabric half; instead, its guider 10*p* (FIG. 1) is returned to non-selected position, and the presently patterning pile thread 12*p* (shown as a dash-dot line) again becomes a simple walewise-running unlooped thread tied into the rear fabric half, i.e., just as it was prior to the second illustrated course. In the rear fabric half, as shown, the three pile threads available, when not actually patterning run as unlooped threads. The pile thread 12*p* just discussed is, when running as unlooped thread, shown to be the leftmost one of the three unlooped pile threads of the rear fabric half.

In the rear fabric half shown in FIG. 11, the middle one of the rear fabric's three unlooped pile threads does not at any point become a patterning pile thread, in the part of the fabric actually depicted.

In the rear fabric half shown in FIG. 11, the rightmost one of the rear fabric's three unlooped pile threads was the patterning pile thread in the first illustrated course. In the first illustrated course, it was brought forward to form a half-loop in the front fabric half, first course, right wale, then brought back to form in the rear fabric half a half-loop in the first course, right wale, thereof, and then became a non-patterning pile thread and, in the second, third and fourth illustrated courses, ran as the rightmost one of the three unlooped pile threads incorporated in the rear fabric half. However, this pile thread once more becomes a patterning pile thread, i.e., when thread 12*p* just discussed at length becomes non-patterning, starting with the fifth course, right wale, of the front fabric half, as shown.

In FIG. 11, the middle one of the three unlooped pile threads incorporated in the rear fabric half is shown as a solid line, and as already stated does not pattern in the part of the fabric actually illustrated.

In FIG. 11, in the left illustrated wales of both the front and rear fabric halves, the half-loops of the patterning pile thread(s) are shown as solid lines, for the sake of simplicity.

In FIG. 7, at 12, it will be seen that patterning pile threads, in the explanatory pattern, pattern for three courses at a time and then become non-patterning, and that some pile threads may be left non-patterning for substantial numbers of courses.

Figure 13:
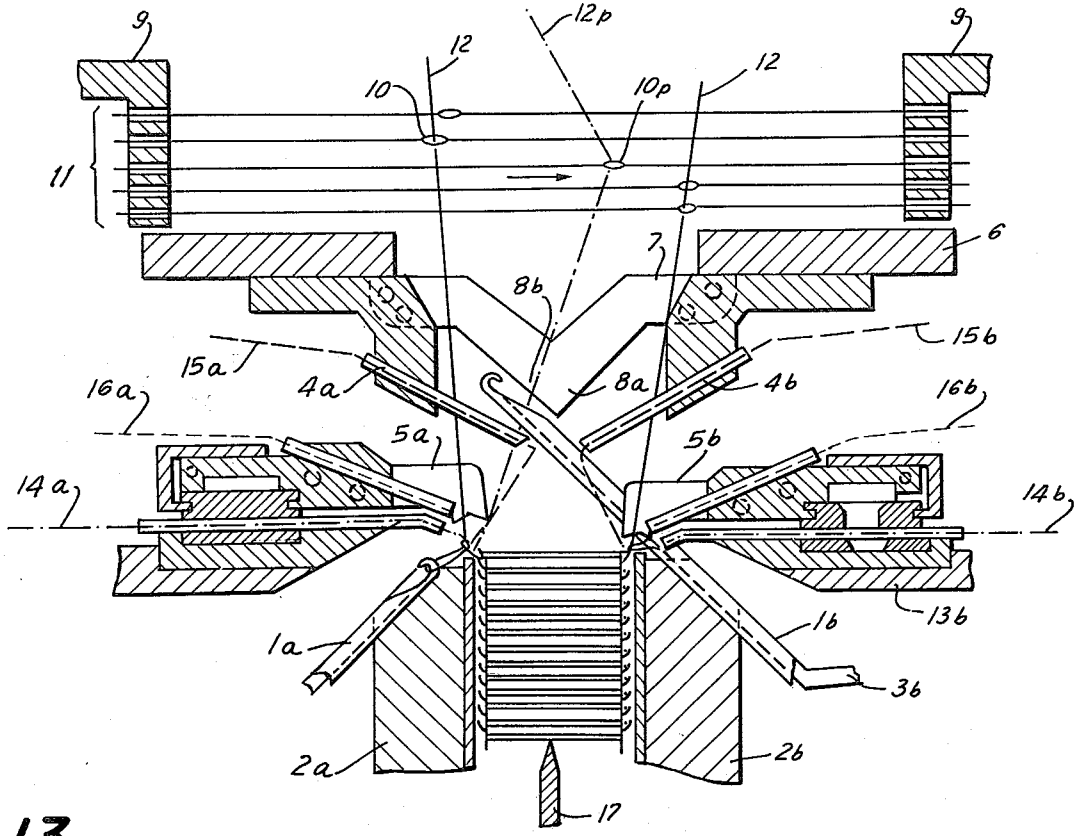
FIG. 13 depicts a modification of the machine of FIG. 1.

FIG. 13 depicts another version of the machine used in accordance with the present invention. In FIG. 13, the machine is again shown as having a set of five pile threads per needle-pair. Here, the machine is set up such that two non-patterning pile threads be incorporated in the fabric half at the side of the left needle-row, with the other two non-patterning pile threads incorporated in the right-side fabric half; it will be understood that the machine of FIG. 1 can be set up in the same way. Because set up in this way, both needles 1*a*, 1*b* of the illustrated needle-pair must be fed a respective one of two stem or vertical threads, i.e., in the manner shown at 16 for the left needle 1*a* of FIG. 1. Attention is also directed to FIG. 10, which depicts the scheme here employed. Here, by way of example, the knitting threads 15 are not laid in accordance with tricot technique (i.e., not as shown at 15 in for example FIG. 7), but instead are laid in accordance with fringe technique (i.e, as shown at 15 in FIG. 12). Consequently, in this example, the loop-clearing sinkers 5 perform a transverse shift in order to lay both the non-patterning pile threads 12 and also the stem or vertical threads 16 underneath needles in alternating directions (i.e., as shown at 12 and at 16 in FIG. 12).

As before, the knitting-thread guiders 4 and the guide comb 6 can advantageously be drivingly coupled together, for simplicity.

As shown at the bottom in FIG. 13, the cutting-apart of the two fabric halves can be performed by a knife 17 provided on the knitting machine itself (and of course this can be done also in FIG. 1), or else be performed later on a separate machine.

It will be understood that each of the elements described above, or two or more together, may also find a useful application in other types of particular methods and constructions differing from the types described above.

While the invention has been illustrated and described as embodied in a method and machine for producing patterned double piled fabrics with minimal consumption of non-patterning pile thread, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for producing a double patterned pile fabric on a warp-knitting machine, the warp-knitting machine comprising two needle-rows, the needles of each needle-row being hooked and being mounted for longitudinal shifting motion between a cast-off position and an extended position, each needle-row defining a general plane, the two general planes defined by the two needle-rows intersecting at a location towards which the needles of a needle-row move when longitudinally shifted from cast-off to extended position, each needle of a needle-row being located substantially directly opposite to a corresponding needle of the other row and constituting therewith a needle-pair, the two needle-rows accordingly being constituted by a row of such needle-pairs, the method comprising the steps of:

(a) longitudinally shifting one and then the other needle of each needle-pair, in alternation, from cast-off to extended position and back to cast-off position;

(b) feeding knitting threads, one per needle, to the needles of one needle-row and effecting the production of one ground fabric, and feeding further knitting threads, one per needle, to the needles of the other needle-row and effecting the production of another and corresponding ground fabric;

(c) feeding to each needle-pair a respective set of pile threads of which differing ones are at differing times in the production of the fabric to become patterning pile threads visible in the fabric's pile pattern, the feeding of each set of pile threads being performed using a respective set of individually displaceable pile-thread guiders;

(d) for so long as a given one of the set of pile threads is not to be a patterning pile thread, keeping it out of the vicinity of the position which the hooks of the needles of the needle-pair assume when in extended position in order that the non-patterning pile thread not be caught by the hook of either needle of the needle-pair, and instead tying the non-patterning pile thread into a first of the two ground fabrics in the form of an unlooped walewise-running thread;

(e) then, when such non-patterning pile thread is to become a patterning pile thread, displacing its pile-thread guider and thereby it in the direction from the first ground fabric towards the second ground fabric and laying it across the second needle of the needle-pair when the second needle is in extended position, so that both the patterning pile thread and also a knitting thread be during return of the second needle to cast-off position caught in the second needle's hook to tie the pile thread into the second ground fabric in the form of a half-loop accompanied by a loop of knitting thread;

(f) then, with this patterning pile thread now extending between its pile thread guider and the case-off location of the second needle of the needle-pair, laying this pile thread across the first needle when the latter is in extended position so that both this patterning pile thread and also a knitting thread be during return of the first needle to cast-off position caught in the first needle's hook to tie this pile thread into the first ground fabric as a half-loop accompanied by a loop of knitting thread; and (g) then, when this patterning pile thread is to again become a non-patterning pile thread, displacing its pile-thread guider and thereby it towards one of the two ground fabrics and once more tying the now again non-patterning pile thread into the last-mentioned one of the two ground fabrics once more in the form of an unlooped walewise-running thread.

2. The method defined in claim 1, the step recited at (g) comprising displacing the patterning pile thread's pile-thread guider and thereby the patterning pile thread back towards the first ground fabric and once more tying the now again non-patterning pile thread into the first ground fabric once more in the form of an unlooped walewise-running thread.

3. The method defined in claim 1, repeating the steps recited at (d), (e), (f) and (g) as often as the pile thread is to become a patterning and then once more a non-patterning pile thread, the last-mentioned ground fabric in step (g) being always the first ground fabric.

4. The method defined in claim 3, for some of the needle-pairs the first ground fabric being the one produced by one of the two needle-rows and for others of the needle-pairs the first ground fabric being the one produced by the other of the two needle-rows.

5. The method defined in claim 4, the displacing of the pile-thread guider being performed when the needle of the row producing the first ground fabric has been shifted to cast-off position.

6. The method defined in claim 1, the displacing of the pile-thread guider being performed when the needle of the needle-row producing the first ground fabric has been shifted to cast-off position.

7. The method defined in claim 1, in steps (c), (d), (e), (f) and (g) the first ground fabric being, for at least one of the pile threads in the set of pile threads fed to the needle-pair, the ground fabric produced by one needle-row, but being, for at least one other of the pile threads in the set fed to that needle pair, the ground fabric produced by the other needle-row.

8. The method defined in claim 2, in steps (c), (d), (e), (f) and (g) the first ground fabric being, for at least one of the pile threads in the set of pile threads fed to the needle-pair, the ground fabric produced by one needle-row, but being, for at least one other of the pile threads in the set fed to that needle pair, the ground fabric produced by the other needle-row.

9. The method defined in claim 1, in step (b) the knitting threads being fed to the needles of the two needle-rows in accordance with tricot technique and in each needle-row accordingly being in successive courses laid onto the needles of differing needle-pairs to form zig-zag warp-stitch chains; furthermore including the step of feeding to the two needle-rows stuffer threads for incorporation into the two ground fabrics; in steps (d) and (f) the patterning pile thread being tied into the ground fabric as a walewise-running unlooped thread tied in between the stuffer thread and the sinker loops of the knitting thread.

10. The method defined in claim 1, in step (b) the knitting threads being fed to the needles of the two needle-rows in accordance with fringe technique and in each needle-row accordingly being in successive courses laid onto the needles of the same needle-pairs repeatedly, in steps (d) and (f) the patterning pile thread being tied into the ground fabric as a walewise-running unlooped thread confined to a single wale but alternating in direction along the length of such wale.

11. The method defined in claim 3, in step (c) the number of pile threads in the set of pile threads fed to at least some needle-pairs being fewer than three; furthermore including the step of feeding into the first ground fabric at each of those needle-pairs receiving fewer than three pile threads a further strengthening thread and incorporating the strengthening thread into the first ground fabric as an unlooped walewise-running thread in the same manner as the non-patterning pile threads, but with the strengthening thread at no point in the fabric becoming a patterning pile thread.

12. In a warp-knitting machine, in combination, means mounting two rows of hooked knitting needles to form two needle-rows the needles of which are longitudinally shiftable between a cast-off position and an extended position, each needle-row defining a general plane, the two general planes defined by the two needle-rows intersecting at a location towards which the needles of a needle-row move when longitudinally shifted from cast-off to extended position, each needle of a needle-row being located substantially directly opposite to a corresponding needle of the other needle-row and constituting therewith a needle-pair, the two needle-rows accordingly being constituted by a row of such needle-pairs;

knitting-thread feeding means comprising two rows of knitting-thread guiders, each such row associated with a respective needle-row and including one knitting-thread guider per needle of the associated needle-row;

pile-thread feeding means comprising a plurality of sets of pile-thread guiders, each set of pile-thread guiders being located at a respective one of the needle-pairs, each pile-thread guider being provided with mounting means mounting the pile-thread guider for individual displacement within the angular sector included between the two general planes of the two needle-rows from non-selecting positions located remote from the bisector of said angular sector to selecting positions located past the bisector;

a guide-comb structure including a row of guide-comb sinkers, one guide-comb sinker per needle-pair, the guide-comb sinkers being located within said angular sector, and the row of guide-comb sinkers extending in the direction in which the row of needle-pairs extends, each guide-comb sinker having two laying edges, one laying edge being located close to the needle hooks of one needle-row when the latter are in extended position, the other laying edge being located close to the needle hooks of the other needle-row when the latter are in extended position, the guide-comb structure being transversely shiftable so that when transversely shifted the laying edges of its sinkers lay the pile threads guided by those pile-thread guiders which are in selecting position across those needles which are in extended position; and two rows of loop-clearing sinkers, each row of loop-clearing sinkers cooperating with a respective one of the two needle-rows, the loop-clearing sinkers serving to guide those pile-threads whose pile-thread guiders are in non-selecting position into the ground fabric to be produced by one of the needle-rows.

13. The combination defined in claim 12, the knitting-thread guiders each being so located that the needles of the respective needle-row when in extended position are located between it and the needles of the other needle-row.

14. The combination defined in claim 12, furthermore including two rows of stuffer-thread guiders, each row of which is associated with a respective one of the two needle-rows, each row of stuffer-thread guiders being located between the cast-off locations of the respective needle-row and the respective row of loop-clearing sinkers.

15. The combination defined in claim 12, the knitting-thread guiders and the guide-comb structure being coupled together for shared transverse shifting motion.

16. The combination defined in claim 12, the pile-thread guiders being thin rods provided with eyelets through which the respective pile threads are to pass, and the means mounting the pile-thread guiders being means mounting the thin rods for longitudinal displacement.

17. The combination defined in claim 12, the knitting-thread guiders comprising small guide tubes through which knitting threads are to pass.

* * * * *